US011548042B2

(12) United States Patent
Jasper et al.

(10) Patent No.: US 11,548,042 B2
(45) Date of Patent: Jan. 10, 2023

(54) APPARATUS AND METHOD FOR CLEANING INDUSTRIAL PARTS

(71) Applicant: ROBOWASH PTY LTD., Henderson (AU)

(72) Inventors: Frank Raymond Jasper, Perth (AU); John Snell Jacob, Perth (AU)

(73) Assignee: ROBOWASH PTY LTD., Henderson (AU)

( * ) Notice: Subject to any disclaimer, the term of this patent is extended or adjusted under 35 U.S.C. 154(b) by 305 days.

(21) Appl. No.: 16/924,986

(22) Filed: Jul. 9, 2020

(65) Prior Publication Data

US 2020/0338606 A1 Oct. 29, 2020

Related U.S. Application Data

(62) Division of application No. 15/839,369, filed on Dec. 12, 2017, now Pat. No. 10,744,538.

(60) Provisional application No. 62/433,520, filed on Dec. 13, 2016.

(51) Int. Cl.

| | |
|---|---|
| ***B08B 3/04*** | (2006.01) |
| ***B08B 3/02*** | (2006.01) |
| ***F02B 77/04*** | (2006.01) |
| ***B08B 3/08*** | (2006.01) |

(Continued)

(52) U.S. Cl.

CPC ..... *B08B 3/047* (2013.01); *B08B 3/02* (2013.01); *B08B 3/08* (2013.01); *B08B 3/14* (2013.01); *B08B 13/00* (2013.01); *F02B 77/04* (2013.01); *F02B 2077/045* (2013.01)

(58) Field of Classification Search

CPC ..... B08B 3/047

See application file for complete search history.

(56) References Cited

U.S. PATENT DOCUMENTS

| | | | |
|---|---|---|---|
| 3,016,841 | A | 1/1962 | Albertson et al. |
| 3,439,689 | A | 4/1969 | Zadron et al. |
| 3,452,763 | A | 7/1969 | Ballard |

(Continued)

FOREIGN PATENT DOCUMENTS

| | | | |
|---|---|---|---|
| CN | 2542507 | Y | 4/2003 |
| CN | 102015130 | A | 4/2011 |

(Continued)

OTHER PUBLICATIONS

An Office Action issued by the Indian Patent Office dated Oct. 27, 2020 in connection with Indian patent application No. 201827046012.

(Continued)

*Primary Examiner* — Jason Y Ko

(74) *Attorney, Agent, or Firm* — Baker & McKenzie

(57) ABSTRACT

A cleaning apparatus includes a wash chamber, a platform and a lid. The platform is disposed in the chamber and sized to support an engine block. The lid has a first portion rotatably coupled to the wash chamber and a second portion rotatably coupled to the first portion. When the first portion of the lid is disposed in a position rotated distal to the wash chamber, the second portion of the lid is disposed in a position rotated proximal to the first portion of the lid. When the first portion of the lid is disposed in a position rotated proximal to the wash chamber, the second portion of the lid is disposed in a position rotated distal to the first portion of the lid.

14 Claims, 8 Drawing Sheets

(51) Int. Cl.
*B08B 13/00* (2006.01)
*B08B 3/14* (2006.01)

(56) References Cited

U.S. PATENT DOCUMENTS

| | | | | |
|---|---|---|---|---|
| 4,995,409 | A | 2/1991 | Watts | |
| 5,149,441 | A | 9/1992 | Welch, II et al. | |
| 5,277,208 | A | 1/1994 | Mansur | |
| 5,482,064 | A | 1/1996 | Goddard | |
| 5,640,981 | A | 6/1997 | Niemela et al. | |
| 5,672,212 | A | 9/1997 | Manos | |
| 6,044,852 | A | 4/2000 | Epperson, Jr. et al. | |
| 2004/0016540 | A1 | 1/2004 | Jarchau et al. | |
| 2006/0037635 | A1 | 2/2006 | Rhodes | |
| 2008/0035184 | A1 | 2/2008 | Wagner et al. | |
| 2008/0210276 | A1 | 9/2008 | Porter et al. | |
| 2008/0210280 | A1* | 9/2008 | Publ | B08B 3/006 134/57 R |
| 2011/0067736 | A1 | 3/2011 | Publ | |
| 2012/0006363 | A1 | 1/2012 | Milojevic et al. | |
| 2016/0001335 | A1 | 1/2016 | Forster | |

FOREIGN PATENT DOCUMENTS

| | | | |
|---|---|---|---|
| EP | 2415532 | A1 | 2/2012 |
| EP | 2832879 | A1 | 2/2015 |
| EP | 2932879 | A1 | 10/2015 |
| JP | 2010274145 | A | 12/2010 |
| WO | 96/20047 | A1 | 7/1996 |
| WO | 2004091817 | A1 | 10/2004 |
| WO | 2009134809 | A1 | 11/2009 |
| WO | 2017203357 | A1 | 11/2017 |

OTHER PUBLICATIONS

A First Office Action issued by the Chinese Patent Office dated Dec. 14, 2020 in connection with Chinese patent application No. 201780031971.4.

An extended European search report issued by the European patent office dated Dec. 6, 2019 in connection with European patent application No. 17879746.0.

An extended European search report issued by the European patent office dated Dec. 6, 2019 in connection with European patent application No. 17802267.9.

An International Search Report and the Written Opinion of the International Searching Authority dated Mar. 1, 2018 in connection with PCT/AU2017/000269.

A First Office Action issued by the Chinese Patent Office dated Jul. 12, 2021 in connection with Chinese patent application No. 201780077245.6.

* cited by examiner

APPARATUS AND METHOD FOR CLEANING INDUSTRIAL PARTS

CROSS-REFERENCE TO RELATED APPLICATION

This application is a divisional of U.S. patent application Ser. No. 15/839,369, filed on Dec. 12, 2017, which claims priority to U.S. Provisional App. Ser. No. 62/433,520, filed on Dec. 13, 2016, each of which are hereby incorporated by reference in their entirety.

BACKGROUND

Large industrial parts use custom equipment for adequately cleaning such parts. For example, large engine blocks, such as V16 and V20 engine blocks cannot be cleaned with conventional cleaning equipment. Accordingly, cleaning equipment that accounts for the size and weight of large industrial parts, while allowing for rapid fluid replacement capability is desired.

BRIEF SUMMARY

The cleaning apparatus according to the present disclosure has been developed to meet certain performance requirements, such as being capable of externally cleaning the stripped-down V16 and V20 Cat engine block (or engine blocks of similar size and weight) with caustic soda wash solution for rebuild maintenance. The cleaning apparatus is further capable of internally flushing the engine block oil passages with caustic wash solution, rinsing the engine block internally and externally with clean water and rust inhibitor, and meeting final particle contamination protocol requiring 50 μm residual particle size limit. The cleaning apparatus described herein is able to perform such cleaning operations using limited volumes of recirculated wash and rinse fluids and maintains operator safety by reducing or eliminating hazards associated with the use of acid tanks, for example. The cleaning apparatus is also sized and shaped to limit the workshop space occupied by the apparatus both while operating and while open for loading/unloading. Further, the cleaning apparatus is capable of performing a reasonable number of cleaning operations between wash fluid replacements, reducing the amount of waste generated, and allowing rapid, low-cost and safe fluid replacement maintenance and service.

The cleaning apparatus of the present disclosure has several unique features that facilitate the above-described cleaning operations, both individually and in combination. The cleaning apparatus may include a frame with a space-saving lid that does not increase the footprint of the apparatus when the lid is opened and closed to accommodate insertion of the large industrial part for cleaning. The cleaning apparatus may includes a high load capacity rotating platform with shock protection disposed within the frame and to accommodate the large industrial part thereon. The cleaning apparatus may include a flexible hose that pivots within the frame to provide internal flush capability as well as tanks for delivery of dual fluids (for example, caustic and fresh rinse) during the cleaning process. The cleaning apparatus may include a heat exchanger that allows for rapid fluid replacement capability by cooling the fluid. The heat exchanger and the reduced volume of fluid complement to reducing time needed for fluid replacement. The cleaning apparatus may include a ventilation and steam recovery system, and include a self-driving, self-cleaning, self-stirring, self-heating caustic fluid tank.

BRIEF DESCRIPTION OF THE DRAWINGS

Reference is now made to the following descriptions taken in conjunction with the accompanying drawings.

DETAILED DESCRIPTION

Various embodiments of a cleaning apparatus for cleaning large industrial parts and related methods according to the present disclosure are described. It is to be understood, however, that the following explanation is merely exemplary in describing the devices and methods of the present disclosure. Accordingly, several modifications, changes and substitutions are contemplated.

Figure 1:
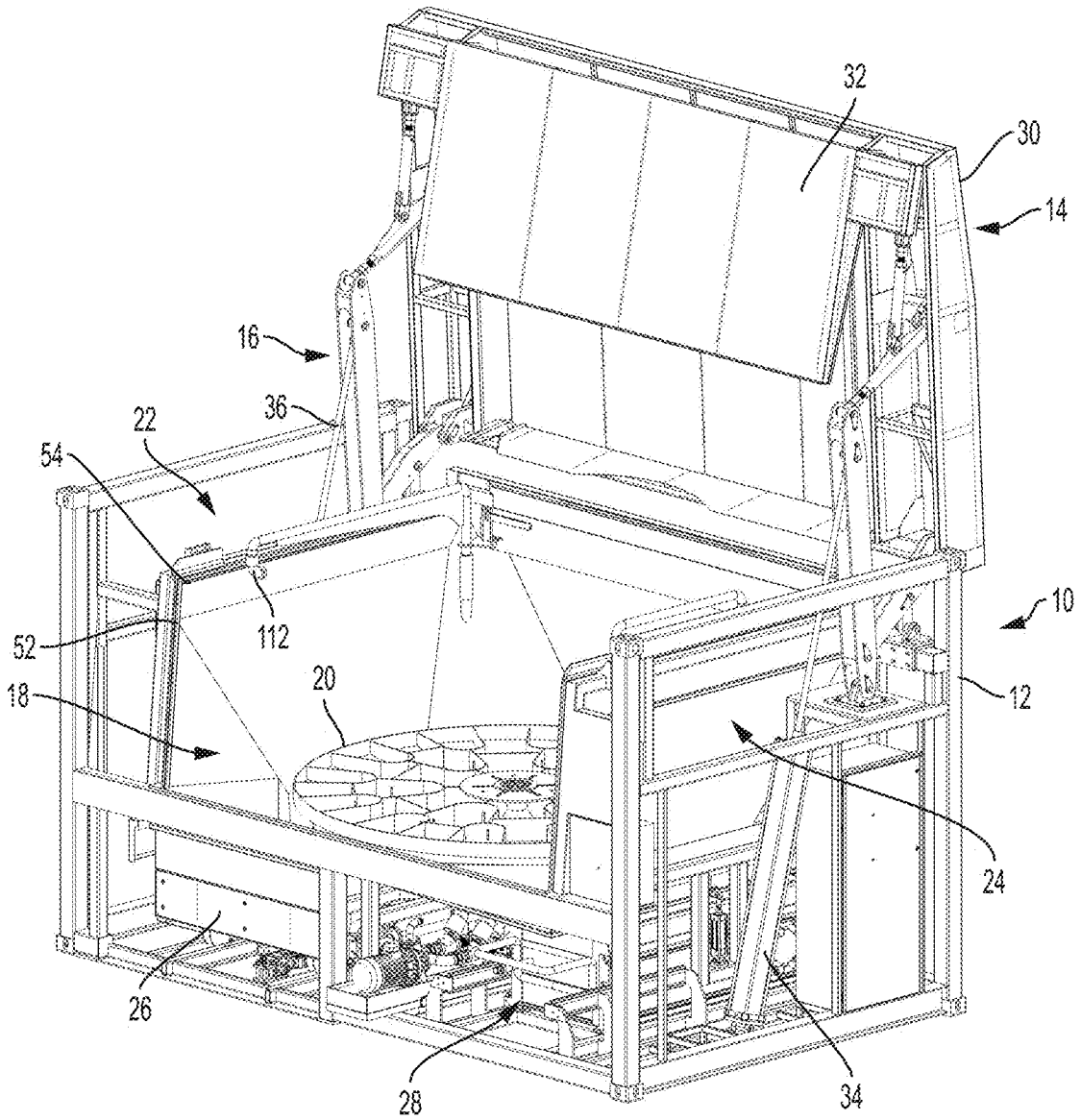
FIG. 1 is a perspective view of an exemplary cleaning apparatus.

Referring to FIG. 1, a cleaning apparatus for cleaning large industrial parts according to the present disclosure is depicted as having reference numeral 10. The cleaning apparatus 10 is depicted in the open position for receiving a large industrial part or parts, such as a V20 engine, for cleaning. The cleaning apparatus 10 includes a frame 12 and lid 14 operatively coupled to the frame via a linkage structure 16 as will be described in further detail. The frame 12 and lid 14 cooperate to define a wash chamber 18 having a platform 20 disposed therein for receiving the large industrial part. The cleaning apparatus 10 further includes a pair of end cavities 22, 24 disposed on the sides of the wash chamber 18. The end cavities accommodate the linkage structure 16. The cleaning apparatus further includes a pair of fluid tanks 26, 28 disposed underneath the wash chamber 18 and end cavities 22, 24 for delivery of fluid during the cleaning process as will be described. The cleaning apparatus 10 and associated cleaning method disclosed herein comprises several unique individual features, which also collectively impart overall uniqueness to the cleaning apparatus. The individual features are described herein in turn.

Lid

The lid 14 includes a top portion 30 and a front portion 32, which cooperate with the linkage structure 16 and actuators 34, 36 to provide for upwards-opening of the lid in order to limit or, more preferably, avoid consuming space in front of or to the side of the cleaning apparatus 10. This allows for maintaining valuable workshop space available for other uses as well as reducing occupational health and safety issues and may avoid requirements for confined space entry permits. The front portion 32 of the lid 14 provides personnel access to the front of the wash chamber 18, which allows for rigging and unrigging loads, load positioning, for the inspection of parts after wash, and for cleaning & maintenance. The top portion 30 combined with the front portion 32 of the lid 14 provides clear access for overhead loading. The front portion 32 folds inwards when fully open leaving the wash chamber fully accessible from overhead, which improves access for the rigging and unrigging of the loads. Further, the depth of the lid 14 is reduced to accommodate the front portion 32 and to provide for side-to-side rigidity for maintaining closing alignment, and to reduce the clearance space required behind the cleaning apparatus 10.

The linkage structure 16 is preferably located at the inside apex between the top portion 30 and front portion 32 of the lid 14 to accommodate a positive seal between the top and front portions. When the lid 14 is fully closed, this seal closes securely on itself. The sides of the top and front portions 30, 32 also do not interfere with the linkage structure 16 in this location. Moreover, the top portion 30 may encompass the full width of the wash chamber 18, thus providing full overhead access and allowing the lid 14 to be actuated from within the end cavities 22, 24 rather than from inside the wash chamber 18 or outside the cleaning apparatus 10. The actuators 34, 36 (e.g., pneumatic cylinders) may be completely protected both from external impacts or environmental effects, and from internal exposure to the caustic wash solution. With the lid 14 fully or partially open, any malfunction of the lift actuators 34, 36 does not cause the lid to fall because of the safety features included by design in the pneumatic system.

Figure 2:
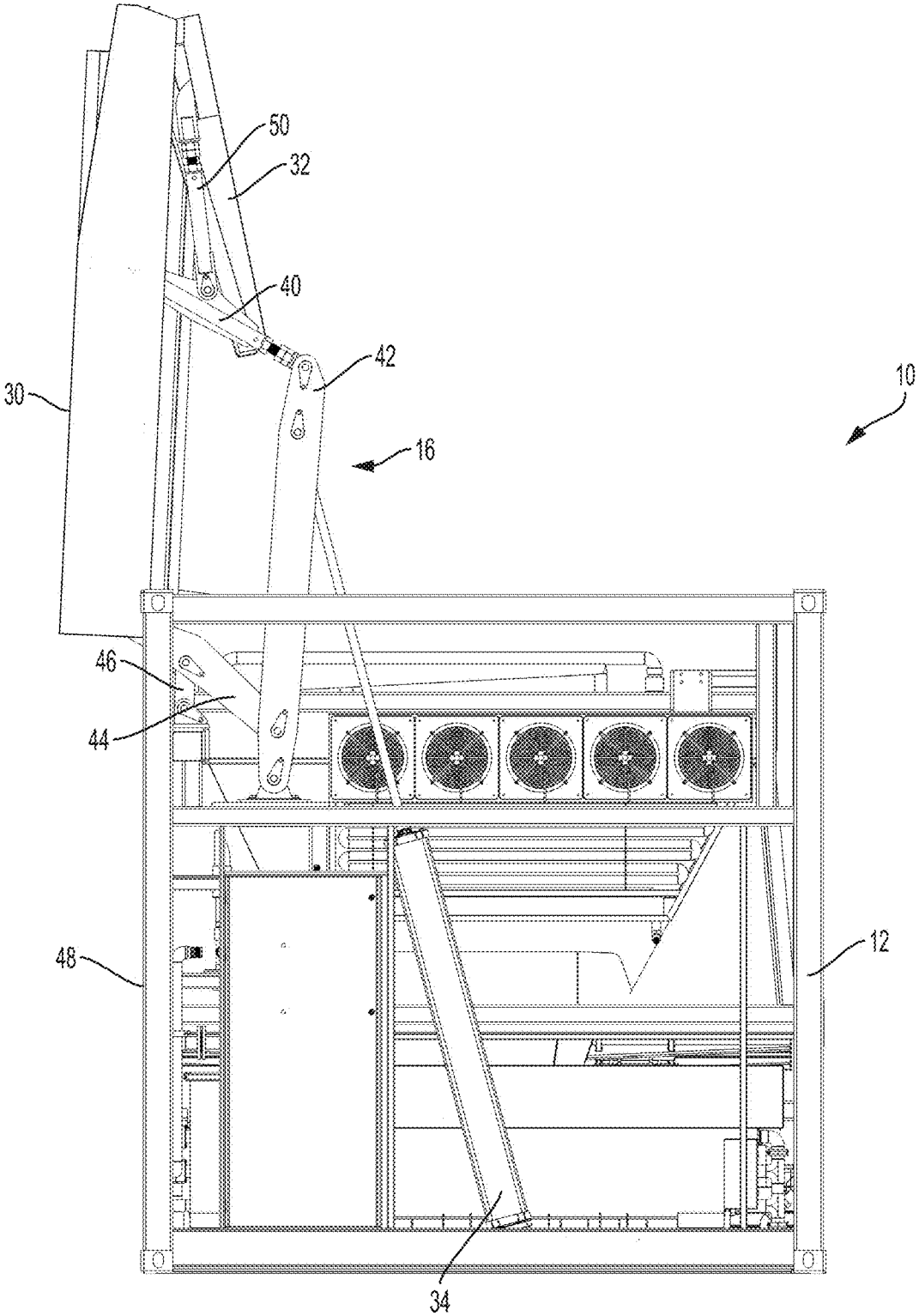
FIG. 2 is a side view of an exemplary cleaning apparatus.

In one embodiment, the linkage structure 16 includes a 6-element hinge at each end of the lid 14 and is operable to raise and then pivot the top portion 30 while simultaneously folding the front portion 32 out of the way after it clears the wash chamber 18. As shown in FIG. 2, linkage arms 40, 42, 44 and the top portion 30 of the lid 14 form a 4-bar linkage that operates inside the footprint of the cleaning apparatus 10 and avoids the need for pivot points extending outside the outer boundary of the cleaning apparatus either on the ends or back of the apparatus. The position of the pivot of the main linkage 42 has the effect that the lid 14 is initially raised vertically up off its seals before pivoting back to open.

A fifth linkage 46 guides the lid 14 into its fully vertical final position above and slightly behind a rear wall 48 of the cleaning apparatus 10. The length and pivot points of linkage 46 are selected to reduce the clearance space required behind the apparatus 10 while increasing the overhead exposure of the wash chamber 18 for loading/unloading. Linkage 46 may support the lid's entire weight when open. The front portion 32 of the lid 14 also includes a linkage 50 that causes the front portion 32 to first rise up and clear the wash chamber 18, and then fold back vertically against the top portion 30 of the lid 14 to provide clear access to the wash chamber from overhead.

The linkage arms and the actuators of the linkage structure 16 are located within the end cavities 22, 24 and are thus protected from damage during transport or from nearby workshop activities. The linkage structure 16 is also separate from the wash chamber 18 and thus is not exposed to the wash fluid, which may include caustic chemicals. The fully enclosed location of the linkage structure 16 additionally reduces potential safety hazards to personnel and the possibility of entangling rigging, hoses, electrical cables or the like.

The actuators 34, 36 may be pneumatic or hydraulic cylinders on each side of the cleaning apparatus 10 that produce the lid's motion without the need for sensors or controls by the use of a specific cylinder stroke length corresponding to the full range of lid motion, fully closed to fully open. The actuators 34, 36 stop fully extended when the lid is fully open limiting further motion, and stops fully retracted when the lid is fully closed and resting on its seals.

The required stroke length of the actuators 34, 36 is provided with a trunnion mounting arrangement that may increase use of the available space required for the actuators without increasing the overall height of the unit. A rod lock at the top of the cylinders may be included for additional safety. If a loss of pressure or emergency stop condition occurs, the rod lock engages and limits or prevents any motion of the lid 14.

Position indicator switches on one of the actuators inform a Programmable Logic Control (PLC) system of the lid's status as either fully open, fully closed, or in transition. More complex continuous rotary or linear position sensors are not necessary. The double-acting cylinders use flow limiting valves to provide steady motion and appropriate opening/closing speeds. The use of pilot valves may provide fail-safe operation. Any loss of pressure or even severing of all pneumatic or hydraulic lines causes the cylinder to hold position, making it possible to prevent the lid from falling unexpectedly. This provides a second layer of safety in addition to the rod locks.

The PLC control algorithm operates the cylinders smoothly to control the motion of the lid 14 and reduce the time required to operate the lid. For example, the upper cylinder may be fully vented when the lid is closed and at rest with the rod locks engaged. In this configuration, the lid may respond immediately to a "lid open" command without the 20 or 30 seconds that would otherwise be needed to vent the cylinder. When the lid is opening and reaches the "tipping point" at which the center of gravity moves behind the hinge pivot point, a burst of air/fluid may be added to the upper cylinders to provide additional braking and cushioning for the final stage of opening. When the lid is preparing to close, the lower cylinders are first re-pressurized to provide air/fluid for braking so that the lid does not drop too rapidly. Further, the release of air/fluid from the lower cylinders may be delayed slightly, and after the tipping point is passed on the downward stroke, the lid is allowed to close the rest of the way under its own weight alone. When the lid is closing and nearly closed, a limit switch on each cylinder serves as a leveling sensor: whichever side (if any) reaches the leveling point first, the lower cylinder pilot valve for that side closes, stopping the release of air/fluid thus stopping the progress of that cylinder. When both leveling sensors (right and left) are reached, the lid carries on closing, for example, by gravity. This has the effect of leveling the lid in the event that one side closes faster than the other through misadjustment, uneven weight, or uneven wear of seals. This also has the effect of arresting the momentum of the closing lid, providing a soft, smooth, and above all safe closure.

The interface between the lid sections 30, 32 and the wash chamber 18 is provided with soft rubber seals. The seal is preferably substantially softer than those for smaller wash units to accommodate the longer length of the sealing surface. For example, the seal 52 may have a hollow section, and may be wider to accommodate potential minor lid misalignments. The weight of the lid 14 is sufficient to compress the seals 52 for an air-tight closure, which preferably prevents wash fluid from exiting the wash chamber 18. Spray guards 54 are provided on the inside of the wash chamber 18 to limit direct spraying of the seals from inside and channel runoff from the lid 14 away from the seals. The interface between the top and front lid sections 30, 32 is likewise provided with a rubber seal, which compresses when the front and top sections form a 90° angle. This seal is likewise provided with a spray guard, which extends to cover the hinge point between the top and front sections.

Platform

The platform 20 disposed in the wash chamber 18 is sized and shaped to receive large industrial parts thereon, such as large engines. In some embodiments, the platform 20 is designed to handle weights as large as 6 tons of static load and over 12 tons of dynamic load. The platform is preferably strong enough to accommodate the large industrial part being dropped onto the platform 20. The platform 20 is arranged to maintaining a high degree of rigidity while requiring less material.

Figure 3:
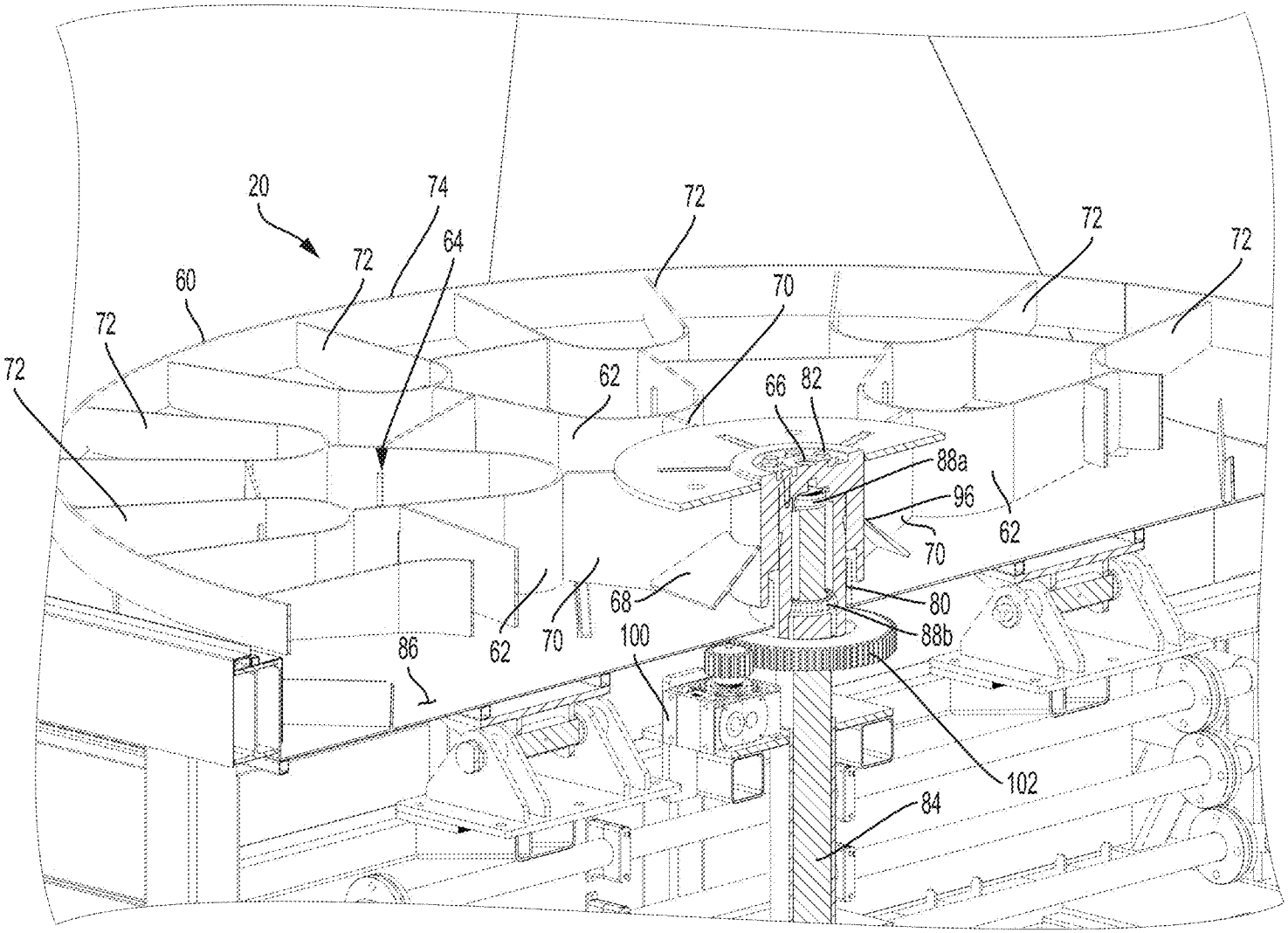
FIG. 3 is a cross-sectional perspective view of an exemplary wash chamber.

Referring to FIG. 3, the platform 20 includes a steel mesh-surfaced rotating platform 60 that is set in a horizontal orientation. In one embodiment, the platform 20 includes concentric branched "oxbow" elements 62 with pre-cut tenons and mortise joints 64. The platform 20 is coupled to a central platform hub 66 that is braced 68 against the large compressive forces that it must withstand. In some embodiments, the structure for the hub is like that of a rib-braced externally-pressurized pressure vessel. In one embodiment, a plurality radial plates 70 interlock with the central hub and spread the first circle of oxbows. In the example shown in FIG. 3, three plates 70 are illustrated in the partial cross-section and six plates 70 are included circumferentially. In the case where there are six plates 70, there may be six oxbows 62 branching from the six plates and each braced to its neighbor near their tips in the first circle. An outer circle may include twelve oxbows 72, each one attached to an end of an inner-circle oxbow 62. Adjacent outer oxbows not sharing an inner branch (e.g., alternating oxbows) may be braced together near their base. An outer rim 74 is provided about a periphery of the platform 20 and may be circular.

The vertical height of the ribs and braces provided by the ox-bows 62, 72 decreases from the central hub 66 towards the outer rim 74, forming an approximate "equal strain" structure that makes efficient use of the material. The mortise-and-tenon construction allows simple assembly and welding of pre-laser-cut parts that does not require jigs, clamps, and repeated measurements in order to complete. Thus, the platform 20 may be less time-consuming to fabricate, have higher strength than a standard radial rib design, and it weigh less than other designs of similar strength.

Figure 4:
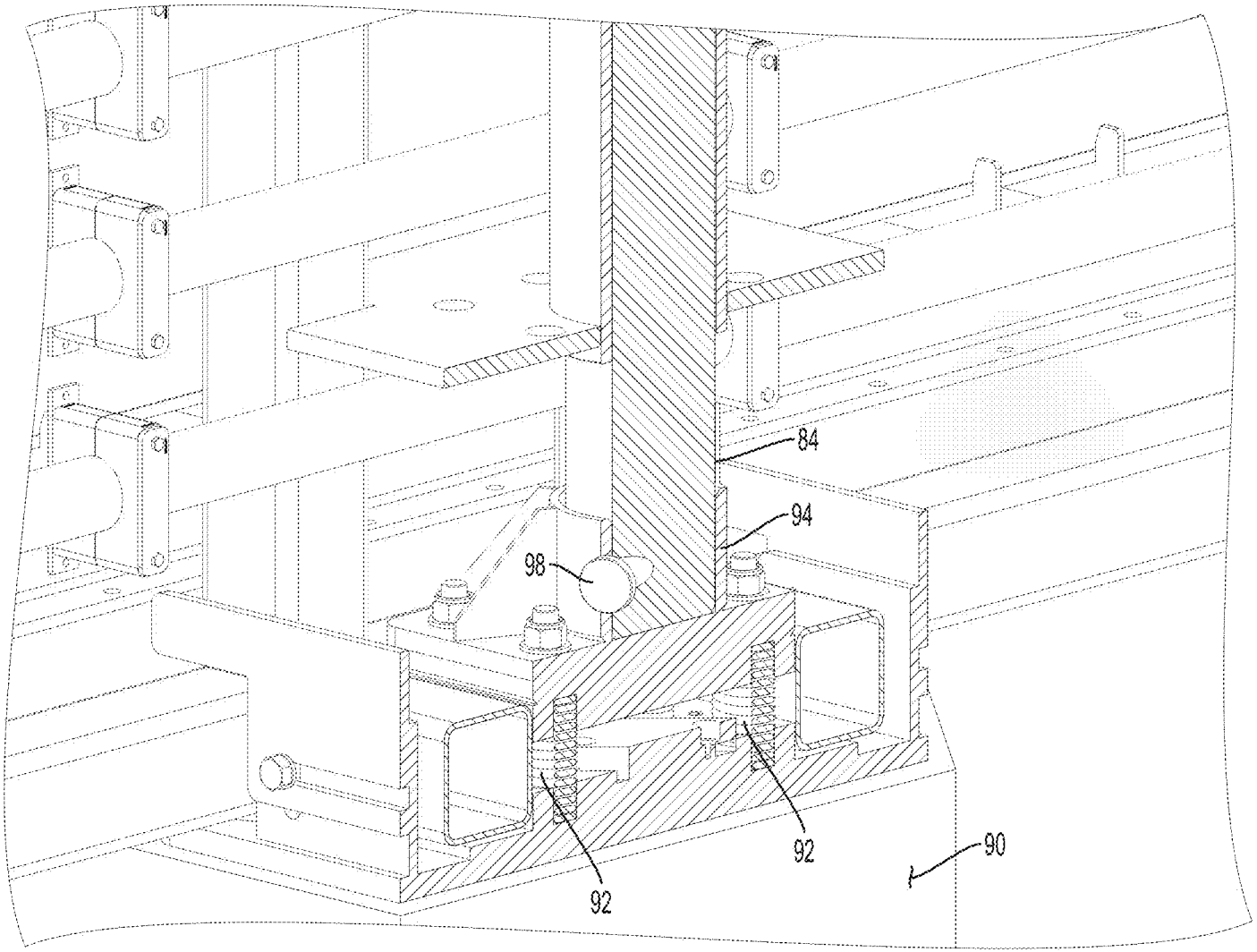
FIG. 4 is a cross-sectional perspective view of an exemplary rotating platform with shock protection.

With reference to FIGS. 3 and 4, the platform 20 is positioned on a hub rotor 80 using high-strength bolts 82 to support the maximum off-center load specified above. The number and size of the bolts, the bolt-circle radius, and the strength rating of the bolts may specifically to meet the design load requirements. The platform hub assembly may transfers its load directly to the shop floor, via spindle 84 passing through a deck 86 of the wash chamber, and between the wash unit 10's internal components.

The hub 66 is supported on roller-element bearings 88 which, for example, accommodate a full static load (e.g., 6 tons) positioned off-center by up to 350 mm in addition to shock loading, while allowing the platform to rotate freely without undue wear, vibration, or power consumption. The bearings 88 may include an upper radial bearing 88*a* and a lower conical bearing 88*b*. The bearings 88*a* and 88*b* may be included individually or in combination. When provided in combination, the combined mechanical properties may support centered vertical loads as well as loads substantially offset from the center for improved stability. Footings 90 spread the load on the shop floor to maintain point loading well below load limits for concrete floors typical in industrial workshops.

In one embodiment, a suspension system may be provided that includes springs 92 positioned within the footing. The footings are capable of absorbing shock loading limits and maintaining dynamic loads to within the load limits of the roller bearings 88. In one embodiment, the shock absorption system includes twelve (12) matched springs 92 that are made of extra-heavy-load vacuum-degassed rectangular-profile steel alloy compression springs with a maximum travel of 31 mm from a free length of 102 mm (30% compression). The use of an array of high-performance springs also provides fault-tolerance and limits any twisting motion that occurs within individual coil compression springs.

A vertical slide bearing 94 may also be incorporated into the hub assembly to allow vertical motion of the suspended platform, hub and bearings under load while maintaining the hub upright and vertical.

The hub assembly is restrained horizontally and to a vertical orientation by integrating with the frame of the unit through a box section that restricts both front-to-back and left-to-right tilting while leaving open spaces to the left and right for the large wash and rinse tanks as well as the pump, valves, and other components. Front-to-back restraint is provided through the shearing strength of the box section, while left-to-right restraint is uniquely provided through the torsional stiffness of the same box section.

The design of the hub, bearing and suspension system provides easy access for periodic maintenance on wear components (e.g., bearings) and replacement of components that may be damaged by the heavy loads encountered during operation. The hub rotor 80 can be pulled using an integral pulling ridge 96 machined into the outer rim. With the rotor removed, the bearings can be pulled and re-fitted. The hub spindle 84 if bent through over-loading or exceeding center-offset limits can be lifted out of the machine and replaced by removing pin 98. Suspension springs can likewise be removed and replaced if damaged.

The hub, bearings and suspension system design preferably fully protects sensitive components from contact with wash fluid. Features of the design reduce or prevent ingress and accumulation of moisture.

The platform 20 is configured to rotate. In one embodiment, the platform 20 includes a drive system that rotates the platform at a speed chosen to provide optimal cleaning of part surfaces (e.g., at 3 revolutions per minute (RPM)). The drive system includes a drive motor 100 for imparting motion to a straight-cut gear 102 with a face width that allows the platform to float on the suspension springs. The additional face width provides engagement of the gears for a wide range of platform loading.

In one embodiment, the drive motor utilizes a variable-speed drive (VSD) and applies selected acceleration and deceleration rates to maintain the motor and reduction gearbox torque within a preferred range. For example, a fully loaded platform may be accelerated from 0 to 3 RPM within no less than 5 seconds so that the torque ratings of the motor, gearbox, drive gears and spindle are not exceeded.

Drive torque and power may be selected to accommodate a slight tilt in the platform of about 1°, which can result in an alternating lifting and lowering of the maximum platform load when placed far off-center.

The cleaning apparatus 10 may include a display, such as a bar graph indicator or other visual indicator of the drive motor torque (based on VSD amps). This facilitates troubleshooting of the platform drive by indicating when motor torque becomes excessive or periodic, due for example to obstruction of the platform or excessive tilt of the unit.

Internal Flush

As discussed previously, the cleaning apparatus 10 may be used to clean large industrial parts, such as large engines. In connection with cleaning large engines, it is desirable to flush internal oil passages in order to clean such passages. In the present disclosure, a flexible hose is fitted via an end plate to the end of the engine block in such a way as to align the hose outlet with the oil passage inlet to flush the internal oil passages.

The hose 110 is coupled to a swivel 112 that may be positioned directly over the center of rotation of the platform, thus allowing the engine block to rotate on the platform 20 while connected to the hose 110. This is advantageous as operators do not have to stop operation of the cleaning apparatus 10 during a wash to connect or disconnect the flush hose 110, and thereby risk exposure to the hot caustic wash solution as well as expending the requisite time and effort is reduced.

The exits of the oil passages on the engine block are preferably partially blocked using cover plates with drain holes placed in them so that the entire oil galley may be flushed by limiting the flow of fluid through the largest apertures, while simultaneously allowing debris to be flushed from all parts of the oil galley.

The hose swivel 112 is supported by a swing arm 114, which includes a braced rigid pipe 114 through which the wash fluid is pumped during internal flush portions of the wash process. The hose 110 may be positioned out of the way during loading and unloading of the engine block or other apparatus via the swivel 112. A locking mechanism 116 is provided to allow for the hose to be locked into a desired position. Sensors may be provided to confirm that the hose is locked into a correct position. This may avoid damage to the cleaning apparatus 10 that could occur if fluid were pumped through an unsecured flex hose 112.

Figure 5:
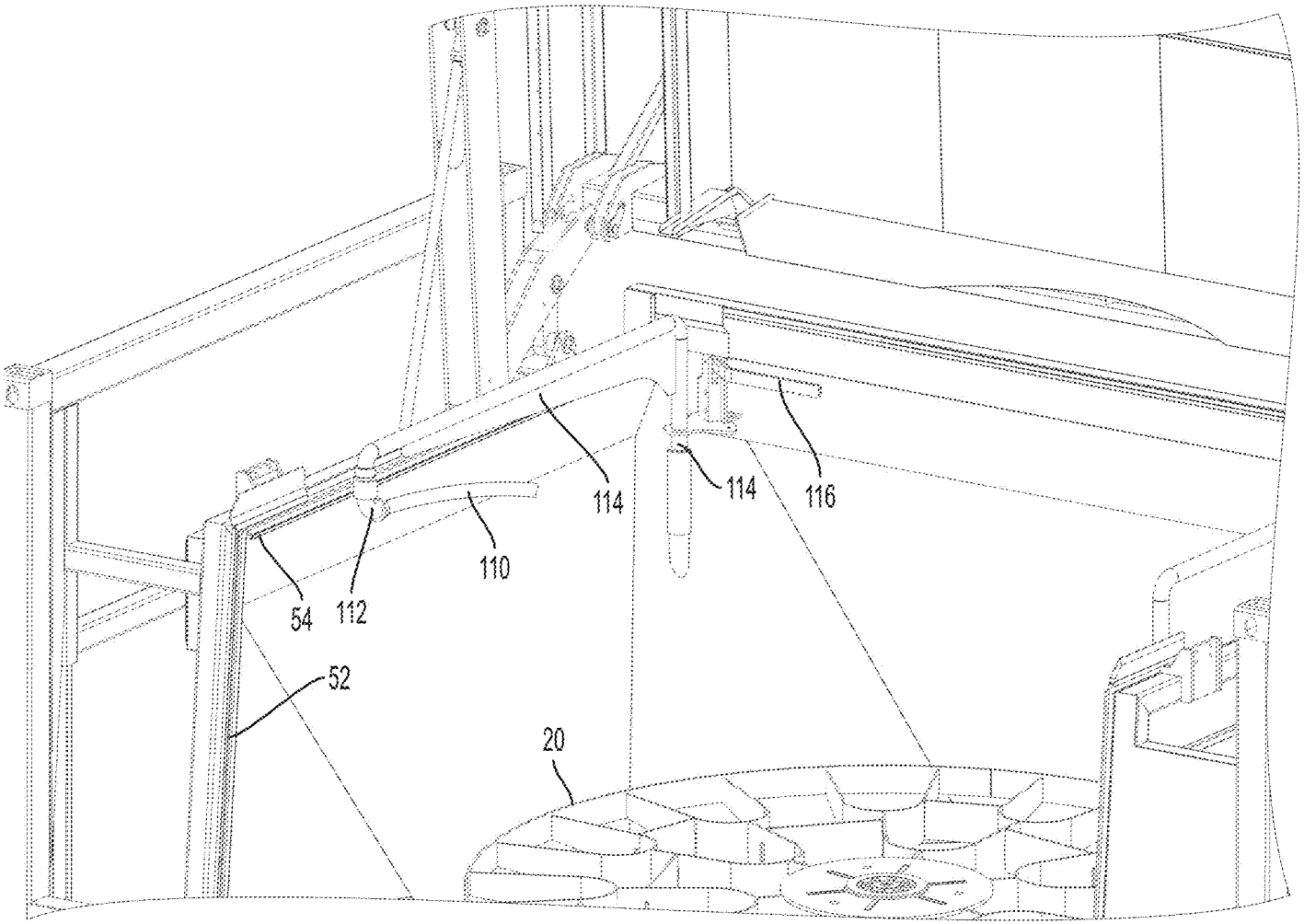
FIG. 5 is a perspective view of an exemplary wash chamber.
Figure 6:
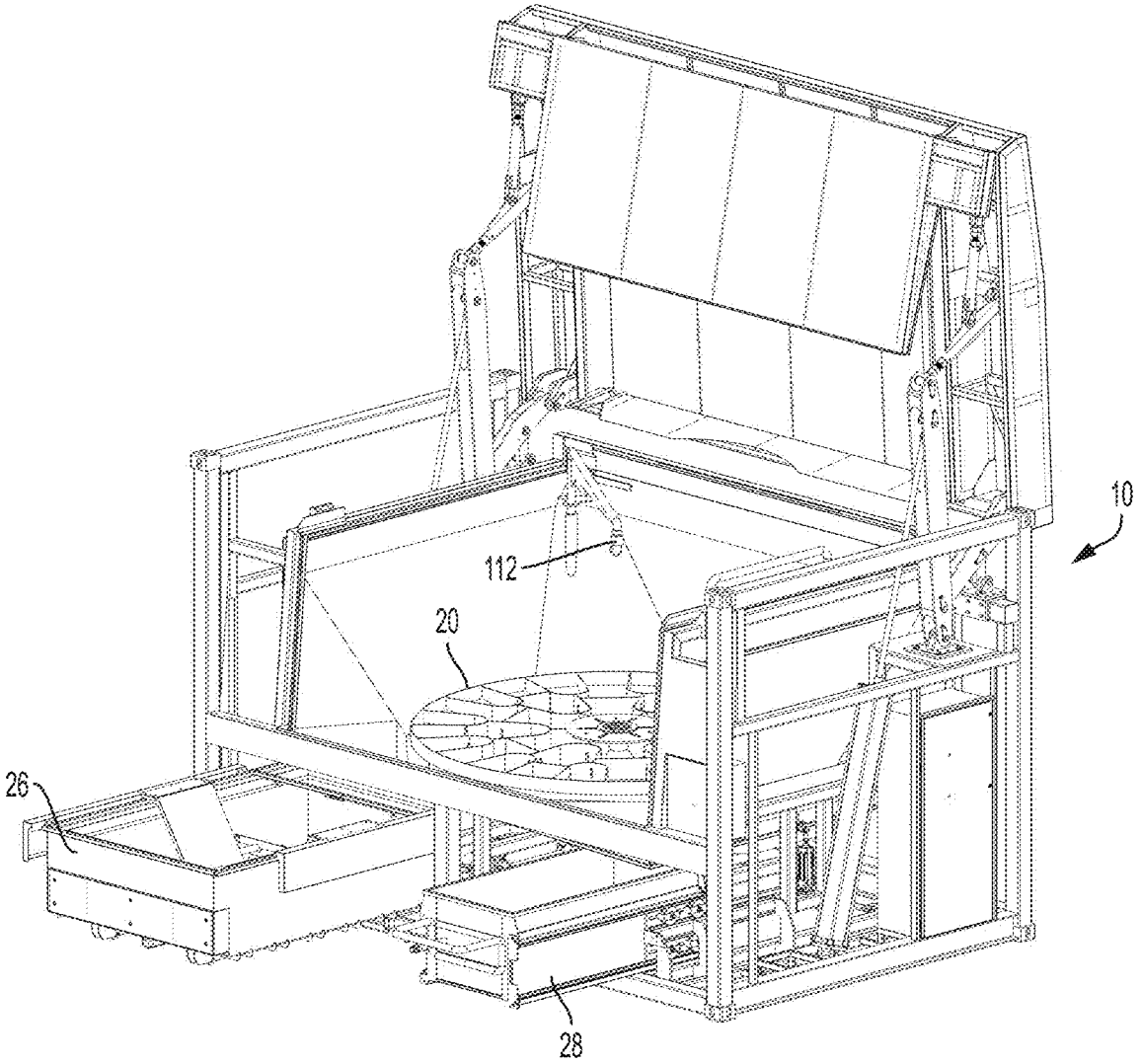
FIG. 6 is a perspective view of an exemplary cleaning apparatus.

The hose swivel is illustrated in a stowed position in FIGS. 1 and 5 and in an extended position over the platform 20 in FIG. 6.

The internal flush efficacy is further improved by periodically stopping the internal flush, allowing time for the wash or rinse fluid to drain from the engine block oil passages, and then re-starting the internal flush pumping. This has the effect of causing particles that may be trapped in blind passages or in vortices near the partially blocked exit points to be entrained in the flow and removed from the engine block. When this is done during the rinse stage using rinse fluid that is screened to <50 μm particle size, this method produces a very low particle count within the cleaned engine block, which may be a requirement for a certified rebuild. The ability to produce a low particle count of >50 μm particles within an engine block is an advantageous feature of the cleaning apparatus 10 of the present disclosure.

Dual Fluid System

The cleaning apparatus 10 is able to impart washing operations using both caustic wash fluid and fresh rinse water in the same apparatus. This is unique for a parts washer of this size, particularly where both the wash and rinse fluids may be re-used. The cleaning apparatus 10 is equipped with two tanks 26, 28: one for the caustic wash solution (26) and another for the clean rinse water (28). Each tank may be provided with a pump, a fluid outlet flexible hose, and a fluid return flexible hose.

In one embodiment, each tank may be automatically topped up with replacement water to maintain correct fluid levels. Replacement rinse water enters the rinse tank via the rinse fluid return system after passing through a rust inhibitor dosing system. Replacement wash water may enter the wash fluid tank either through the wash fluid return system or by way of the initial flush stage of the rinse process.

A controller, which coordinates control of the pumps, the fluid outlet control valves, and the return drain fluid control valves maintains separation between the two fluids to limit or avoid any mixing of the fluids. The external spray manifold, for example, may be fed either from the wash pump through its fluid outlet control valve, or from the rinse pump through its own outlet control valve.

During a wash mode, the wash pump is activated, and one of the wash outlet control valves (outer spray or inner flush) is opened. During washing, fluid may accumulate to the side of the wash chamber due to the chamber having a sloped floor. From there, the fluid passes through a coarse screen or grating into a recessed gutter. The gutter slopes toward its center, where the fluid exits into a manifold connected to two drain valves: one returning to the wash fluid tank; the other to the rinse tank.

During wash mode, the wash fluid return valve is opened, allowing fluid from the wash chamber to drain back to the wash fluid tank and be re-used.

In one embodiment, the wash operation includes alternating periodically between spraying the engine block externally and flushing the internal oil passages. This may be performed by alternating the wash fluid control valves. In some embodiments, fluid is diverted to the internal flush hose only when the internal flush swing arm is positively locked in an extended position. Otherwise, the exterior spray circuit may be used alone.

After washing is completed, the cleaning apparatus 10 may carry out a tap water flush process. The purpose of the tap water flush process is two-fold: (1) to flush the majority of caustic fluid remaining on the part being cleaned and in the pipework back into the wash tank; and (2) to top up the wash tank with water to replace that lost to evaporation over the course of the preceding wash cycle. The tap water may be drawn from a separated compartment of the rinse water tank that has not been dosed with rust inhibitor, and thus reduces the consumption of rust inhibitor. The tap-water flush process may include opening both the external spray and internal flush fluid control valves while the rinse pump operates. This continues until either the wash tank reaches nominally full capacity or the supply of flush water is exhausted.

During rinse mode, the rinse pump is activated and one of the rinse fluid control valves is opened. Rinsing is performed by alternating between spraying rinse water on the exterior of the parts, and flushing the internal oil passage (if washing an engine block). Also during rinse mode, the wash fluid return valve is closed and the rinse return valve is opened, allowing rinse water to return to the rinse tank for re-use.

Rapid Fluid Replacement System

The cleaning apparatus 10 according to the present disclosure has the capability to perform a fluid replacement service within a short time window (e.g., 24 hours), thus providing a significant benefit and reducing down time of the cleaning apparatus. For comparison, the few caustic-fluid wash machines in existence can require up to 72 hours for fluid replacement service, which can interrupt operations. Because of their size and cost, rarely are wash machines for large parts available for redundancy making down time a significant concern.

The primary factor in fluid replacement time is the cool-down period. The cleaning apparatus 10 is capable of cooling the wash fluid down to near-ambient temperature within a few hours, such as overnight, starting after the final wash of the day. It is to be appreciated that caustic wash fluid must be cool in order to safely neutralize and remove.

Another factor is the volume of wash fluid. The cleaning apparatus 10 makes efficient use of the fluid, allowing the volume to be kept to a minimum (e.g., 3000 liters, compared to 5000 liters typical in some machines and up to 10,000 liters in agitation tanks). This reduces the cool-down time as well as reduces the cost of fluid replacement and waste treatment/disposal.

A third factor is the ability to withdraw the fluid tanks from the unit, such as illustrates in FIG. 6, without disconnecting any pipework or electrical cabling. Pump outlet and fluid return are both provided on each tank through the use of travelling hoses, which link the moving and stationary portions of the system. Electrical cabling is routed to the tanks via a moving cable tray which separates high voltage cables for the pumps from the low voltage and sensor cables.

A fourth factor is the ability to efficiently mix the wash fluid during neutralization operations and during dosing operations. The self-mixing system reduces the time required to safely add chemicals to the caustic wash fluid tank.

During the cool-down period, the pump operates at low speed and the outlet is diverted to the spray nozzles within the closed wash chamber. Evaporation of the water through the ventilation system rapidly cools the wash fluid. The fluid level may be topped up using supply water, which further cools the fluid.

After washing operations, a neutralizing agent may be added to the wash fluid, which further takes time in the fluid replacement process as the neutralizing agent must diffuse through the fluid, which is often thick sludge or gel-like material with very low ion mobility. Also, the neutralization process is exothermic, meaning that it heats up the fluid lengthening the period of time before the fluid can be replaced. The cleaning apparatus 10 shortens this period by agitating and cooling the fluid during this process.

Fluid replacement also involves dissolving a large quantity (up to 600 kg) of caustic soda granules into the replacement water in the fluid tank. The time required to do this is also reduced by the cleaning apparatus 10 via agitating the tank and cooling. Dissolving caustic soda, such as sodium hydroxide (NaOH) into water H2O is an exothermic process, producing a substantial amount of heat, potentially boiling and splashing caustic liquid if done carelessly. Cooling the fluid while agitating to disperse high concentrations may carry out the process safely and quickly to reduce the time required for this step.

Figure 7:
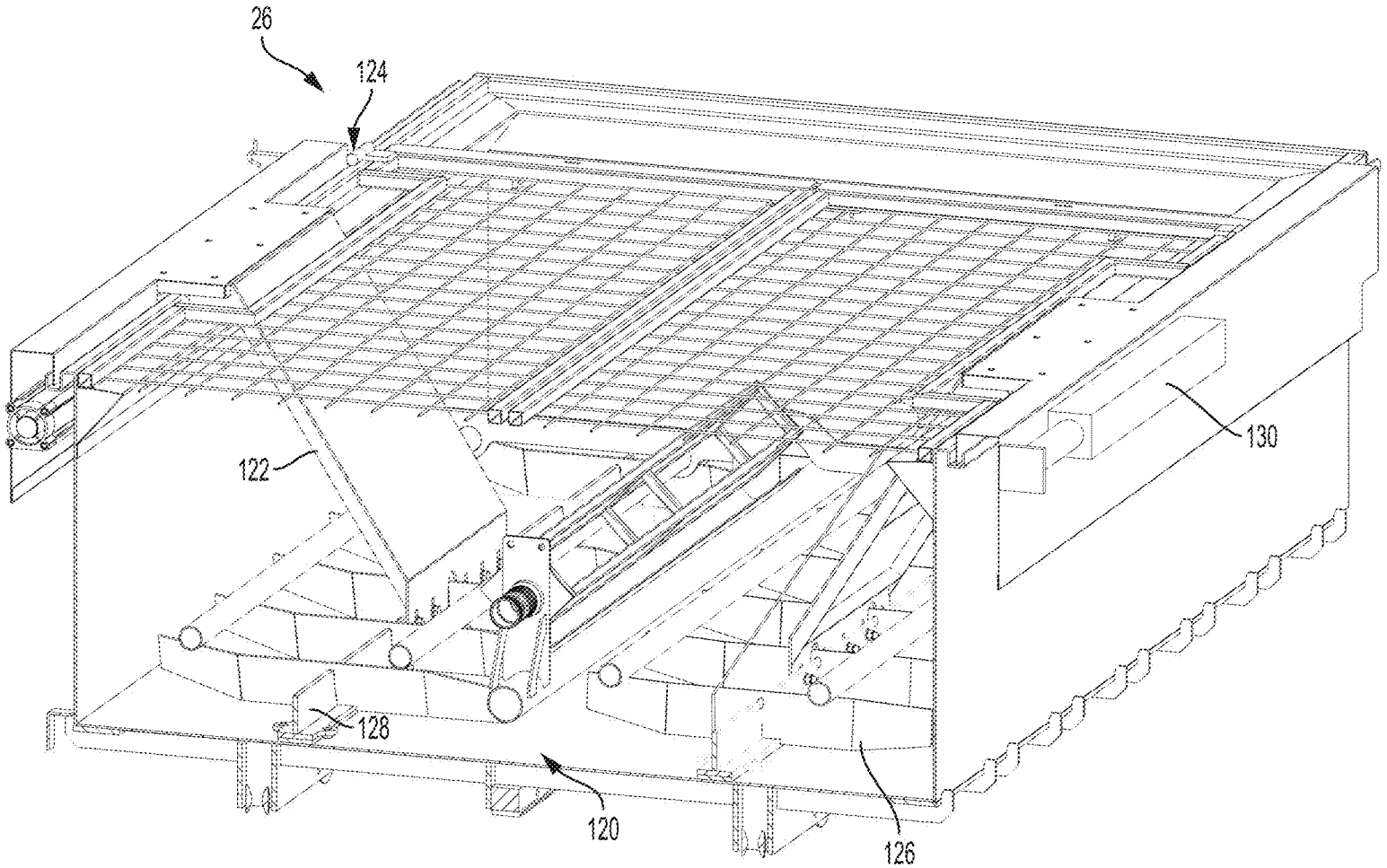
FIG. 7 is a cross-sectional perspective view of an exemplary tank.
Figure 8:
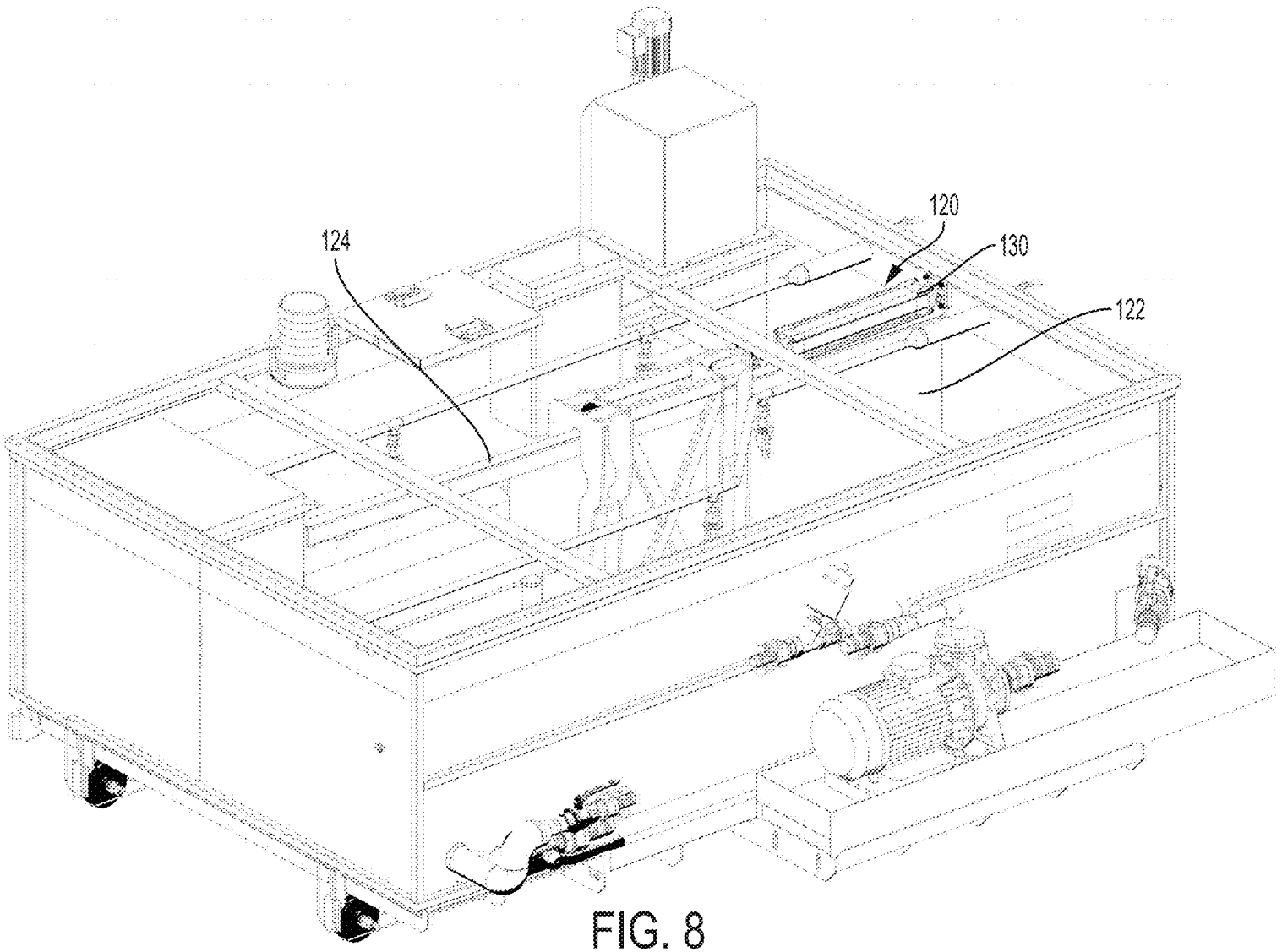
FIG. 8 is a cross-sectional perspective view of an exemplary tank.

Referring to FIGS. 7 and 8, the cleaning apparatus 10 includes a tank agitation system 120 that reduces the neutralizing and dosing times by actively agitating the wash fluid under control of the technician. In the example of FIG. 8, a dividing wall 122 separates the return fluid settling compartment from the pump inlet compartment is provided with a track 124 along the top. On this V-track a bracket mounted on wheels supports a row of submerged paddles 126 (see FIG. 7) positioned slightly above the floor in each of the compartments. In the example of FIG. 7, the wall 122 is provided at one side of the tank without separating fluid settling and pump inlet sections. The bracket and mixing paddles balance upon the mono track and are stabilized using skid plates 128 contacting the divider. The bracket is further provided with a double-acting cylinder 130 attached to the front of the tank which is able to propel the bracket forward and draw it back again. In this manner, the mixing paddles 126 are moved along the bottom of the tank within each compartment in a reciprocating manner when the agitation cylinder 130 is activated. The cylinder 130 may be pneumatic.

Limit switches may be provided on the cylinder 130 to provide the signals used by the controller to reverse the direction of the cylinder at the end of each stroke. Due to its proximity to the caustic wash fluid tank (in some embodiments, the cylinder may be positioned within the wash fluid tank though preferably above the fluid level), the cylinder may be made entirely from non-ferrous metals.

While various embodiments in accordance with the disclosed principles have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

What is claimed is:

1. A cleaning apparatus, comprising:

a wash chamber;

a platform disposed in the chamber and sized to support an engine block;

a lid having a first portion rotatably coupled to the wash chamber and a second portion rotatably coupled to the first portion;

a cleaning fluid tank configured to receive fluid that drains from the platform and to supply fluid to a pump that sprays the fluid towards the platform; and an agitator disposed in the cleaning fluid tank.

2. The cleaning apparatus of claim 1, wherein the platform is sized to support a 16 cylinder diesel engine block.

3. The cleaning apparatus of claim 1, wherein the agitator includes a plurality of paddles disposed in the cleaning fluid tank, the paddles being operatively coupled to an actuator.

4. The cleaning apparatus of claim 1, wherein the cleaning fluid tank is slidingly coupled to a frame of the cleaning apparatus.

5. The cleaning apparatus of claim 1, wherein the platform includes a plurality of plate members configured to allow fluid to drain through the chamber.

6. The cleaning apparatus of claim 5, wherein the plurality of plate members include a plurality of oxbow shaped elements.

7. The cleaning apparatus of claim 5, wherein the plurality of plate members are respectively coupled via a mortise and tenon joints.

8. The cleaning apparatus of claim 5, wherein the plurality of plate members have a height that decreases from a central location of the platform to an outer location of the platform.

9. The cleaning apparatus of claim 1, further comprising a swiveling hose coupling configured to rotate between a stowed position that is not above the platform to an extended position that is above the platform.

10. The cleaning apparatus of claim 1, wherein the lid is coupled to the wash chamber such that when the first portion of the lid is disposed in a position rotated distal to the wash chamber, the second portion of the lid is disposed in a position rotated proximal to the first portion of the lid, and when the first portion of the lid is disposed in a position rotated proximal to the wash chamber, the second portion of the lid is disposed in a position rotated distal to the first portion of the lid.

11. The cleaning apparatus of claim 10, wherein the lid is coupled to the wash chamber via a multi-bar linkage.

12. The cleaning apparatus of claim 11, wherein the first portion of the lid provides a linkage of the multi-bar linkage.

13. The cleaning apparatus of claim 11, further comprising an additional linkage coupling the second portion of the lid to the multi-bar linkage, the additional linkage being configured to cause the second portion of the lid to rotate as the first portion of the lid rotates.

14. The cleaning apparatus of claim 10, further comprising a frame, the wash chamber being disposed within the frame; and an actuator coupled between the frame and the lid and configured to open the lid, the actuator being disposed outside the wash chamber and inside the frame.

* * * * *